United States Patent [19]

Renn

[11] 3,950,065

[45] Apr. 13, 1976

[54] CONNECTING DEVICE HAVING INTEGRAL CONDUCTOR RETAINING MEANS

[75] Inventor: Robert Maurice Renn, Harrisburg, Pa.

[73] Assignee: AMP Incorporated, Harrisburg, Pa.

[22] Filed: Apr. 28, 1975

[21] Appl. No.: 572,591

[52] U.S. Cl. ..... 339/98; 339/258 R

[51] Int. Cl.[2] ..... H01R 9/08

[58] Field of Search ..... 339/95, 97–99, 339/256, 258, 223

[56] References Cited

UNITED STATES PATENTS

| | | | |
|---|---|---|---|
| 1,536,338 | 5/1925 | Glamzo | 339/256 R |
| 2,969,521 | 1/1961 | Scoville | 339/258 R |
| 3,145,261 | 8/1964 | Forney, Jr. | 339/98 |
| 3,596,236 | 7/1971 | Shlesinger, Jr. | 339/270 R |

*Primary Examiner*—Joseph H. McGlynn
*Attorney, Agent, or Firm*—F. W. Raring; Jay L. Seitchik; Robert W. Pitts

[57] ABSTRACT

Stamped and formed connecting device comprises a pair of plate-like members which are connected to each other by integral straps which extend between corresponding ends of the plate-like members conductor-receiving slots extend inwardly from the corresponding ends of the plate-like members so that a conductor can be moved laterally of its axis between the straps and into the slots. Integral retaining fingers extend from the opposed edges of the straps and between the plate-like members transversely of an inserted conductor to prevent movement of the conductor from the slots.

9 Claims, 10 Drawing Figures

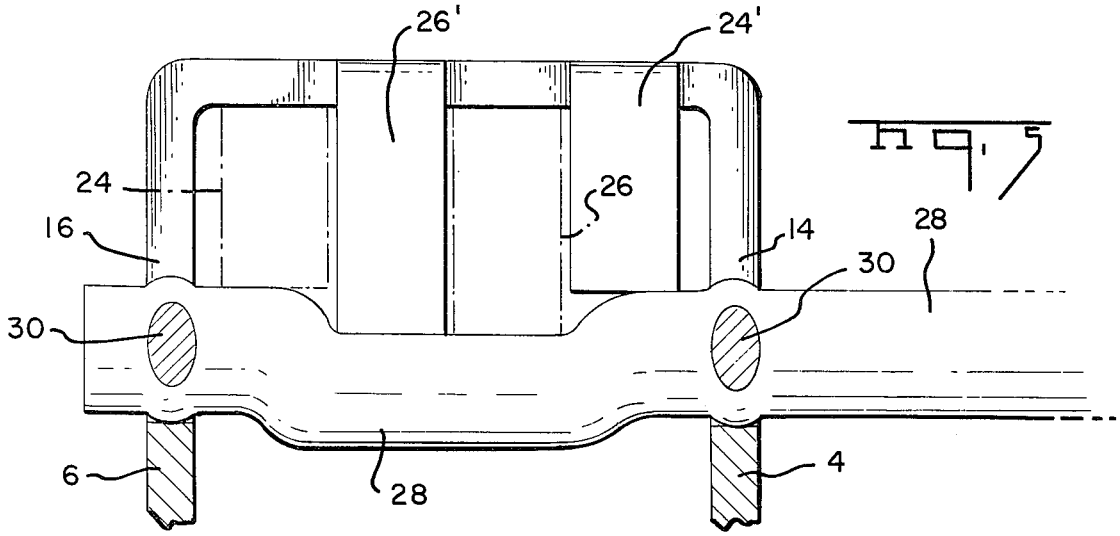
Fig. 5
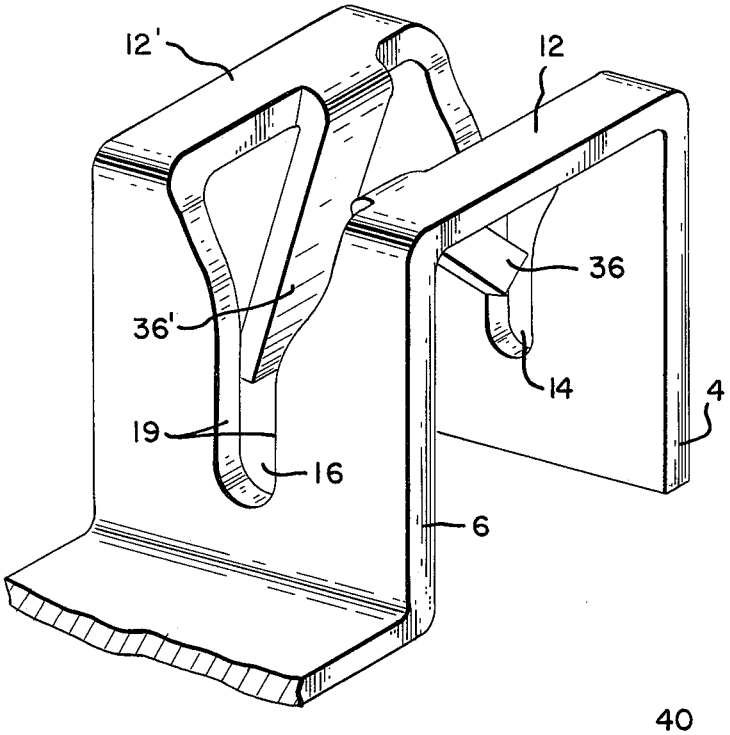
Fig. 6
Fig. 7
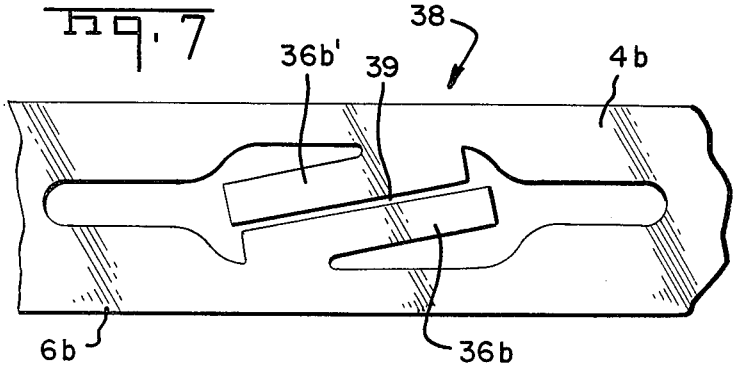
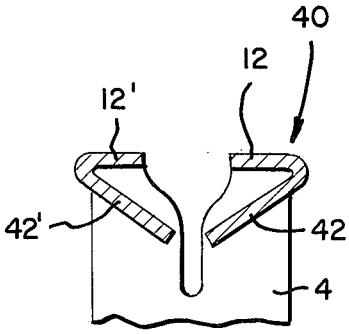
Fig. 8

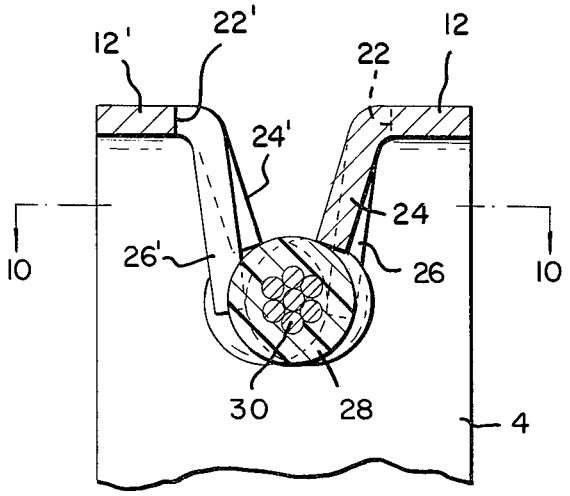
Fig. 9
Fig. 10
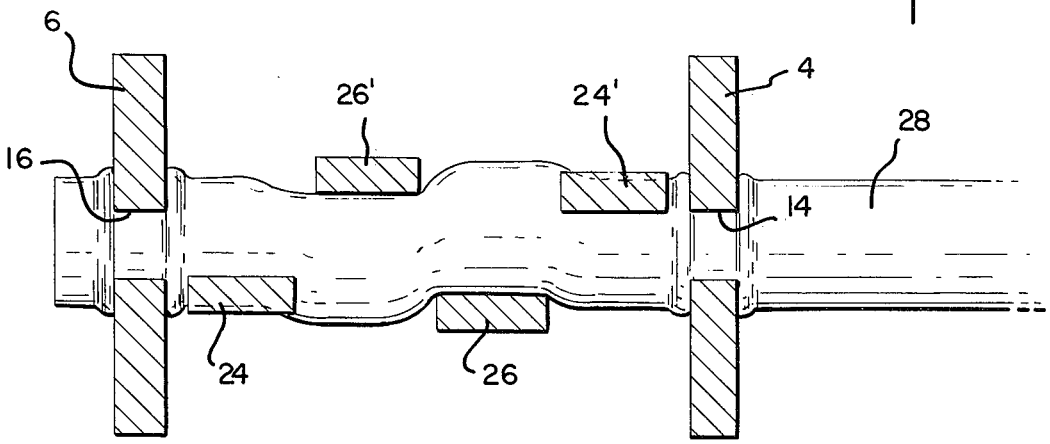

CONNECTING DEVICE HAVING INTEGRAL CONDUCTOR RETAINING MEANS

BACKGROUND OF THE INVENTION

This invention relates to stamped and formed conductor-in-slot connecting devices of the general type first disclosed in U.S. Pat. No. 3,617,983. The herein disclosed embodiment of the invention conforms to the teachings of U.S. Pat. No. 3,760,335 in that the connecting device is of the specific type shown in the latter patent.

U.S. Pat. No. 3,617,983 discloses and claims a conductor-in-slot connecting device comprising a pair of plate-like members which are connected to each other by means of strap members which extend between corresponding ends of the plate-like members. Conductor-receiving slots are provided in the plate-like members which extend inwardly from the corresponding ends thereof so that a conductor can be moved laterally of its axis along a path extending between the plate-like members and into the slots.

The general type of connecting device shown in U.S. Pat. No. 3,617,983 has found wide spread acceptance in the electrical industry, U.S. Pat. No. 3,760,335 for example, shows a connector having terminals therein which have connecting portions of the type described in the earlier patent. These conductor-in-slot connecting devices do not require prestripping of the conductor and they are, moreover, amenable to mass conductor insertion operations as disclosed in U.S. Pat. No. 3,760,335 so that a large number of wires or other conductors can be connected to terminals in an extremely short time.

Under some circumstances, it would be highly desirable to have, as a feature of connecting devices of the type described above, a retaining means which would function to prevent movement of a conductor laterally of its axis and from the conductor receiving slots in the connecting device. Quite often, the retaining means can be provided as a part of some ancillary structure associated with the connecting means; for example the multi-contact connector shown in U.S. Pat. No. 3,760,335 may be provided with a back cover or clamp which grips all of the wires extending to the terminals in the multicontact connector. When this arrangement or a similar arrangement is employed, the portions of the conductors which extend from the clamp to the terminals are isolated from external forces applied to the wires and there is no danger of movement of the wires from the connecting device on the ends of the terminals. However, connecting devices of the type under consideration are sometimes used as free standing devices mounted on a printed circuit board with no ancillary structure such as a housing and a separate stream relative means cannot be provided. Under such circumstances, a wire-retaining and strain relief means in accordance with the instant invention is highly desirable.

It is accordingly an object of the invention to provide an improved conductor-in-slot type connecting device. A further object is to provide a connecting device having improved conductor retaining and strain relief means integral therewith. A further object is to provide a one-piece stamped and formed conductor-in-slot connecting device having improved strain relief and conductor retaining means which can be manufactured at substantially no increase in cost as compared to previously known devices of the same type.

These and other objects of the invention are achieved in preferred embodiments thereof which are briefly described in the foregoing abstract, which are described in detail below and which are shown in the accompanying drawing in which:

FIG. 5 is a view taken along the lines 5—5 of FIG. 4 but showing a full cross-sectional view of the connecting device and the inserted wire.

FIG. 6 is a perspective view of an alternative embodiment.

FIG. 7 is a plan view of the blank from which the connecting device of FIG. 6 is formed.

FIG. 8 is a transverse sectional view of a connecting device in accordance with a further embodiment of the invention.

FIG. 9 is a cross-sectional view of an electrical connection in accordance with a further embodiment of the invention.

FIG. 10 is a view taken along the lines 10—10 of FIG. 9.

Figure 1:
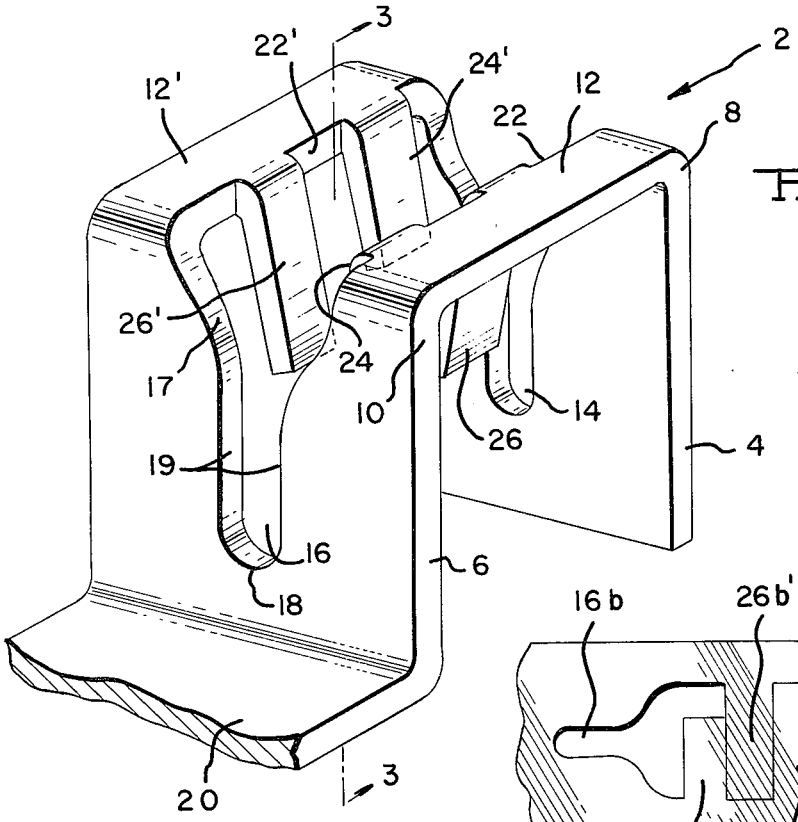
FIG. 1 is a perspective view of one form of connecting device in accordance with the invention.

Referring first to FIG. 1, a preferred form of connecting device 2 in accordance with the invention comprises a pair of parallel spaced apart plate like members 4, 6 the corresponding upper ends 8, 10 of which are connected to each other by parallel spaced apart connecting strap members 12, 12'. Conductor receiving slots 14, 16 extend inwardly in the plate-like members 4, 6 respectively from the upper ends 8, 10, each of these slots having a divergent upper end 17 to guide the conductor into the inner portions of the slot. The opposed edges 19 of the slot 16 are spaced apart by a distance which is significantly less than the diameter of the conducting core 30 of the wire 28 for which the connecting device is intended so that the insulation of the wire will be displaced as the wire is moved into the slot. The core 30 of the wire is plastically deformed and held in intimate contact with the edges 19 so that good electrical contact is established. The edges 21 of ths slot 14 in plate-like section 4 may be spaced apart by a distance which is slightly greater than that of the edges 19 so that the insulation only is partially displaced when the wire enters slot 14 and the wire will be gripped by the edges 21. These slot width relationships insure good electrical contact in the slot 16 and a strain relief for the wire in the slot 14. Thus, a tensile pull applied to the wire will not disturb the electrical contact between the wire core 30 and the connecting device.

The plate-like section 6 has an extension 20 on its lower end which may comprise a contact portion as shown in U.S. Pat. No. 3,760,335. Alternatively the connecting device can be provided with other means for forming a connection to further conductors such as an integral solder pin which is adapted to be soldered to a conductor on a printed circuit board.

The opposed edges 22, 22' of the parallel connecting strap portions 12, 12' are provided with integral retaining fingers 24, 26 and 24' 26'. All of these retaining fingers extend downwardly as viewed in FIG. 1 between the opposed surfaces of the plate-like members 4, 6 and obliquely with respect to the common axis of the slots 14, 16. The fingers 24, 24' are relatively shorter than the fingers 26, 26' and are located immediately adjacent to the plate-like members 6 and 4 respectively. The fingers 26, 26' are centrally located but are offset from the fingers 24, 24'.

Figure 3:
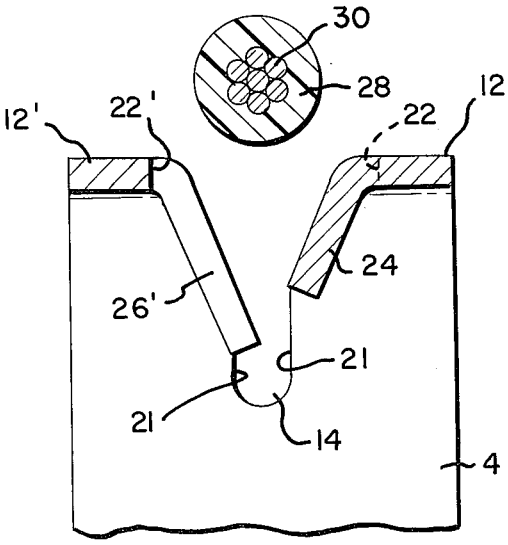
FIG. 3 is a view taken along the lines 3—3 of FIG. 1 and showing a wire positioned for subsequent insertion into the connecting device.
Figure 4:
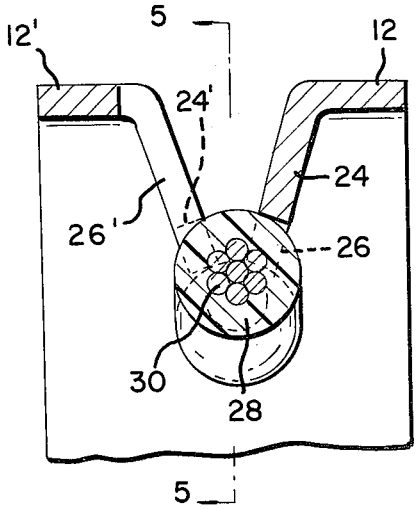
FIG. 4 is a view similar to FIG. 3 but showing the wire as being fully inserted.

In use, the wire is located above the connecting device as shown in FIG. 3 and moved downwardly into the slots 14, 16 until it has moved past the fingers 24, 26, 24', 26'. The fingers are flexed during such movement of the wire but return to their normal positions as shown in FIG. 5 so that the ends of the fingers bear against the inserted wire. It is thus apparent that upward movement of the wire from the position of FIG. 4 is prevented by the fingers and the integrity of the connection will be maintained if a lateral pull is applied to the portion of the wire which extends externally from the plate-like member 4. It is desirable to insert the central portion of the wire to a level which is beyond the portions of the wire which are in the notches 14, 16 so that a slight kink or offset is formed which is beneath the ends of the fingers 26, 26' as shown in FIG. 5. This kink in the wire furnishes additional protection against disturbance of the electrical connection if an axial pull is applied to the external portion of the wire as viewed in FIG. 5. The invention thus provides protection against a lateral pull on the wire and augments the previously available strain relief for an axial pull on the wire.

Figure 2:
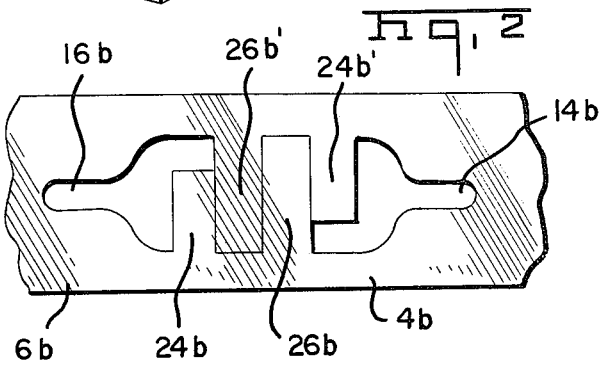
FIG. 2 is a plan view of the blank from which the connecting devices of FIG. 1 is formed.

Connecting devices in accordance with the invention are commonly manufactured from a suitable conductive metal such as brass or berillium copper by stamping and forming operations. The blank shown in FIG. 2 for the connector is made by punching openings **14*b*, 16*b* having enlarged adjacent ends and shearing the material between the openings to define blank portions 24*b*, 26*b*, 24*b'*, 26*b'* which, after the forming operations, become the fingers described above. It will be noted that in accordance with prior methods of manufacturing connecting devices of the type under consideration, the material between the openings in FIG. 2** was punched out and discarded as scrap. The retaining fingers are thus obtained with no added cost in material and with only an minor modification to the stamping and forming die.

FIG. 6 shows an alternative embodiment in which the connecting strap and members 12, 12' each have a single retaining finger 36, 36'. These retaining fingers are each proximate to one of the plate-like members 4, 6 and extend laterally downwardly and towards the other plate-like member. The function and purpose of the fingers 36, 36' is the same as that of the fingers described above with reference to the embodiment of FIG. 1. The connecting device of the FIG. 6 is formed from a blank 38, FIG. 7, in which the openings are punched as shown and the material between the openings are sheared or punched out along a one line 39 to define blank portions **36*b*, 36*b'*** which are subsequently formed to provide the fingers.

FIG. 8 shows a further embodiment 40 which the finger 42, 42' are integral with the outside edges of th connecting straps 12, 12'. In this instance, the fingers are reversely bent downwardly so that they extend beneath the strap portions and obliquely towards each other.

FIGS. 9 and 10 show a further embodiment in which the wire is kinked laterally (rather than downwardly as in FIG. 5) with respect to the longer retaining fingers 26, 26'. This embodiment provides an alternative method of achieving an augmented strain relief against an axial pull on the wire. The downward kink of FIG. 5 or the lateral kinks of FIG. 10 may be preferred, depending upon such factors as the stiffness of the fingers, the flexibility of the wire, and the depth of the slots.

In the accompanying drawing, the conductor is shown as on insulated stranded wire, however, connecting devices in accordance with the invention can also be used to form connections to flat conductors as disclosed in application Ser. No. 368,387 which has been published as published patent application B 368,387.

It will be understood that under some circumstances, it is desirable to insert two wires into the connecting device rather than one wire as shown in the drawing. The instant invention is particularly desirable where two wires are accomodated in the slots for the reason that it has been found that when two wires are inserted one above the other, the resistance of the second wire to removal from the device is less than that of a single wire.

What is claimed is:

1. A one-piece sheet metal stamped and formed connecting device for forming an electrical and mechanical connection with an elongated conductor, said device comprising:

a pair of plate-like members disposed in side-by-side relationship, said members being connected to each other by spaced-apart connecting strap members, said strap members being integral with, and extending between, corresponding ends of said plate-like members, each of said plate-like members having a conductor receiving slot, said slots being in alignment with each other with respect to an axis extending through said slots, said slots extending inwardly from said corresponding ends, flexible conductor retaining means integral with, and extending from at least one of said strap members, said conductor retaining means having portions thereof which are disposed between said plate-like members and which extend transversely with respect to said axis, whereby, upon movement of a conductor laterally of its axis, between said strap members and into said slots, said retaining means is deflected by said conductor, and said retaining means engages said conductor after said conductor comes to rest in said slots and prevents movement of said conductor laterally from said slots.

2. A one-piece sheet metal stamped and formed connecting device for forming an electrical and mechanical connection with an elongated conductor, said device comprising:

a pair of plate-like members disposed in side-by-side relationship, said members being connected to each other by spaced-apart connecting strap members, said strap members being integral with, and extending between, corresponding ends of said plate-like members, each of said plate-like members having a conductor receiving slot, said slots being in alignment with each other with respect to an axis extending through said slots, said slots extending inwardly from said corresponding ends, said connecting strap members having opposed edges, each of said edges having at least one conductor retaining member extending therefrom inwardly between said plate like members and obliquely towards said axis whereby, upon movement of a conductor laterally of its axis along a path extending between said strap members, and into said slots said retaining members are deflected by said conductor and said retaining members engage said conductor after said conductor comes to rest in said slots and prevent movement of said conductor laterally from said slots.

3. A device as set forth in claim 2, each of said connecting strap members having a single conductor retaining member, each of said members being integral with its respective strap member at a location which is proximate to one of said plate-like members and remote from the other plate-like member and extending obliquely towards said other plate-like member.

4. A device as set forth in claim 2, each of said connecting strap members having first and second retaining members extending therefrom, each of said first retaining members being relatively shorter than each of said second retaining members, said retaining members being spaced apart from each other on each of said connecting strap members, the said retaining members on one strap member being offset from said retaining members on the other strap member.

5. A device as set forth in claim 2, said plate-like members being in parallel spaced-apart planes, said connecting strap members extending normally of said planes.

6. An electrical connection between a one piece sheet metal stamped and formed connecting device and an elongated conductor, said device comprising:

a pair of plate-like members disposed in side-by-side relationship, said members being connected to each other by spaced-apart connecting strap members, said strap members being integral with, and extending between, corresponding ends of said plate-like members, each of said plate-like members having a conductor receiving slot, said slots being in alignment with each other with respect to an axis extending through said slots, said slots having open wire-admitting ends which extend inwardly from said corresponding ends, said connecting strap members having opposed edges, each of said edges having at least one conductor-retaining member extending therefrom inwardly between said plate-like members and obliquely towards said axis, said conductor being in said slots, at least one of said slots having opposed edges which are in electrical contact with said conductor, portions of said retaining members extending between said conductor and said wire-admitting ends whereby, movement of said conductor from said slots and from said wire admitting ends is prevented by said retaining members.

7. An electrical connection as set forth in claim 6, each of said connecting strap members having first and second retaining members extending therefrom, portions of said conductor which extend between said plate-like members being kinked, said retaining members being in engagement with said kinked portions of said conductor.

8. An electrical connection as set forth in claim 7, said conductor being kinked in the direction of said conductor receiving slots.

9. An electrical connection as set forth in claim 8, said conductor being kinked laterally of the direction of said conductor receiving slots.

* * * * *